US011644186B1

(12) United States Patent
Strawn

(10) Patent No.: US 11,644,186 B1
(45) Date of Patent: May 9, 2023

(54) DIRECTIONAL GUIDANCE DEVICE

(71) Applicant: David Michael Strawn, Carlsbad, CA (US)

(72) Inventor: David Michael Strawn, Carlsbad, CA (US)

( * ) Notice: Subject to any disclaimer, the term of this patent is extended or adjusted under 35 U.S.C. 154(b) by 0 days.

(21) Appl. No.: 17/448,589

(22) Filed: Sep. 23, 2021

Related U.S. Application Data

(60) Provisional application No. 63/198,063, filed on Sep. 26, 2020.

(51) Int. Cl.

| | |
|---|---|
| ***F21V 21/08*** | (2006.01) |
| ***F21V 19/00*** | (2006.01) |
| ***F21V 21/02*** | (2006.01) |
| *F21Y 115/10* | (2016.01) |

(52) U.S. Cl.
CPC ..... *F21V 21/0808* (2013.01); *F21V 19/0045* (2013.01); *F21V 21/02* (2013.01); *F21Y 2115/10* (2016.08)

(58) Field of Classification Search
CPC .. F21V 21/0808; F21V 19/0045; F21V 21/02; F21V 33/0076; F21V 23/0414; F21V 15/01; F21V 17/108; F21V 21/0832; F21V 21/08; G08B 7/062; G08B 7/066; G08B 7/06; G08B 5/36; F21S 9/022; G09F 2013/05; F21W 2111/02; Y10S 446/901; Y10S 362/802; B60Q 7/00; A47G 1/17; F21L 2/00
USPC ..... 362/555, 558, 559, 576, 581, 164, 189, 362/191, 220, 221, 648, 313, 314, 457
See application file for complete search history.

(56) References Cited

U.S. PATENT DOCUMENTS

| | | | | |
|---|---|---|---|---|
| 5,126,927 A * | 6/1992 | Reeves | F21L 15/02 | 362/205 |
| 5,151,679 A * | 9/1992 | Dimmick | G02B 6/4295 | 362/555 |
| 6,864,799 B2 * | 3/2005 | Popps | G08B 7/062 | 340/693.11 |
| 7,614,765 B2 * | 11/2009 | Reason | F21V 21/0824 | 362/802 |
| 9,872,531 B2 * | 1/2018 | Uke | A42B 3/04 | |

FOREIGN PATENT DOCUMENTS

JP 2010202141 A * 9/2010

* cited by examiner

*Primary Examiner* — Omar Rojas Cadima
(74) *Attorney, Agent, or Firm* — Law Office of Scott C Harris, Inc

(57) ABSTRACT

A directional guidance device that has a half loop at one end that identifies that one end, and allows a number of functions relative to that one end. The directional guidance device produces a stream of or sequence of LED lights which started that one end and travel towards the other end. The half loop also is used to house a pull tab that can be removed to provide an adhesive attachment to a surface. The device attaches via a detachable connection to the adhesive plate, so that the device can be removed from the adhesive plate and a new adhesive plate can be used.

10 Claims, 5 Drawing Sheets

DIRECTIONAL GUIDANCE DEVICE

This application claims priority from Provisional application No. 63/198,063, filed Sep. 26, 2020, the entire contents of which are herewith incorporated by reference.

BACKGROUND

During interior firefighting operations inside a structure, visibility is often very limited due to smoke and steam trapped inside the structure. Firefighting crews perform what is known as Primary and Secondary searches, to find victims trapped inside the structure. Since visibility is low or zero, firefighters rely on their sense of touch to find their way through the structure, using walls as a point of reference, and as guidance to their direction of travel.

The firefighter crew assigned to perform the search typically uses either a right handed search or a left handed search, indicating which hand is to maintain physical contact on the wall that is to be followed through the building. For example, for a right handed search, the wall will stay on the firefighter's right side as they pass ingress through the structure.

Once the search is complete, the crew may then exit the building using the opposite hand to follow the same wall to the exit. That is, if the firefighter is following the wall with their right hand on the way in, they exit the structure following the same wall with their left hand on the opposite direction of travel.

While performing searches under these stressful and high demand situations, firefighters can become lost or disoriented and lose their sense of direction and/or physical contact with the wall they followed into the building. With limited air in their SCBA in an environment filled with toxic smoke, the firefighters priority shifts to finding a means of egress before they run out of air. If unsuccessful, the results can include severe respiratory injury and/or death of the firefighter.

SUMMARY OF THE INVENTION

An embodiment describes a device that provides visual directional guidance, usable in any situation that poses a risk of becoming lost or disoriented. A particularly preferred embodiment describes use by a firefighter for use in interior firefighting.

The present application describes a portable, battery-powered and handheld tool used for visual directional guidance by using sequential illumination of different lighting elements, for the guidance.

In an embodiment, the device is secured onto a flat surface by the user, bound using an adhesive plate. The device provides directional guidance using a sequential lighting strip that creates light that travels in a single direction. The direction in which the light moves depends on the user's placement of the device. The tool has mechanisms, as described herein, that assist the user in mounting the device correctly to ensure that the sequential lighting runs in the desired direction.

Once the firefighting activity is completed, the device is detached from the adhesive plate and can be reused by attaching a new adhesive plate.

BRIEF DESCRIPTION OF THE DRAWINGS

In the Drawings.

the figures show aspects of the invention and specifically.

DETAILED DESCRIPTION

In operation, the "breadcrumb" device 100 is placed on a wall, and turned on, while performing a search for victims. Firefighters can strategically mount the device 100 on the wall that is followed into the building. The firefighter mounting the device, preferably mounts the device low on the wall, approximately 12 inches from the ground and turns the device on, to start the sequential light display described herein.

If a firefighter becomes lost and/or separated from their crew members, they can locate the device by getting low to the ground, under the smoke column, and searching for the illumination given out by the device.

Once located, the device will provide the firefighter with (A) a point of reference identifying the actual wall they followed into the structure and (B) directional guidance by the sequential light display that will point them in the direction of egress. The firefighter may then follow the wall in the direction of the sequential lights to the either the next mounted BreadCrumb, or all the way out of the structure if no other Breadcrumbs were placed.

The amount of BreadCrumbs placed by firefighters can determined by the size and complexity of the interior area being searched and also the amount of BreadCrumbs held by personnel.

The device can also be used during Rescue Intervention Crew (RIC) operations. When a Firefighter becomes trapped, lost or injured, the procedure for that firefighter is to call a "Mayday" over the radio communications channel that is assigned to the incident. Each structure fire has a RIC on stand by, typically a crew of 3-5 firefighters dedicated to locating and extricating the firefighter in need. When activated, the RIC carries with them a bag with specialized rescue tools. BreadCrumbs can be added to this tool bag and used by the RIC to ensure an expeditious exit for the crew once the down Firefighter has been located and is ready for extrication. It can also be utilized to mark the furthest point of ingress by the first in RIC in case they have to exit before finding the down firefighter, providing the next in RIC with a point of reference as to how far the first crew made it in.

Figure 1:
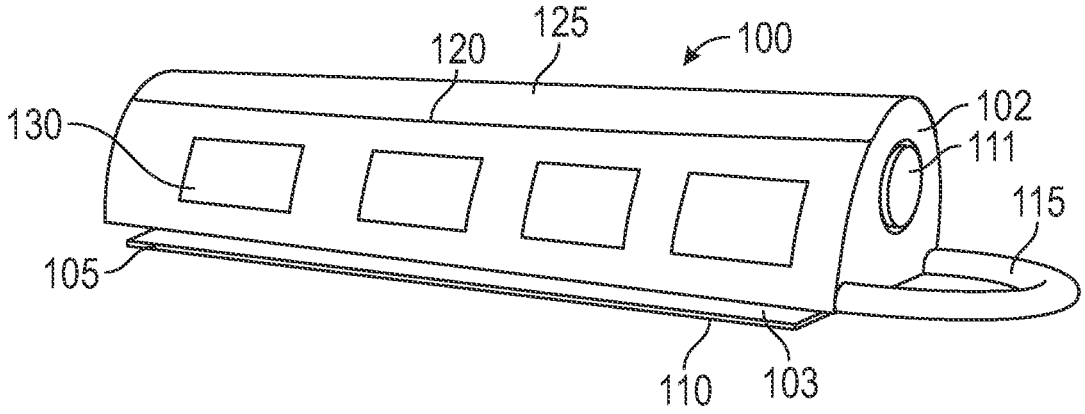
FIG. 1 shows an overall diagram of the device.

The device 100, referred to herein as the breadcrumb device, is shown in FIG. 1. A housing 102, is attached to an adhesive backplate 105 which is coated with adhesive, covered with an adhesive protection film 110.

The housing extends along an axis, the axis from a first edge to a second edge. The half loop device 115 is located at the first edge, and is used in orienting the device, as described herein.**

An on/off switch 111 turns on the sequential lighting effect. A light strip area 120 is located under a lensing area 125. The lights in the light strip are connected to batteries 130 in a battery compartment, as described herein.

The main body housing 102 is a hollow structure constructed from a rugged plastic or rubber material. In an embodiment, the housing can be approximately 5"L×2"W at the base×1.5"H. The LED or Infrared lighting, electronic components and the battery pack are mounted inside the housing. A lens 125 is mounted on top of the housing, to facilitate viewing the sequential illumination of the elements located inside the housing. The housing extends along an axis, from one end of the housing to the other end of the housing. The lens and the sequential illumination can preferably run the length of the housing along that axis also, as described herein.

Figure 3:
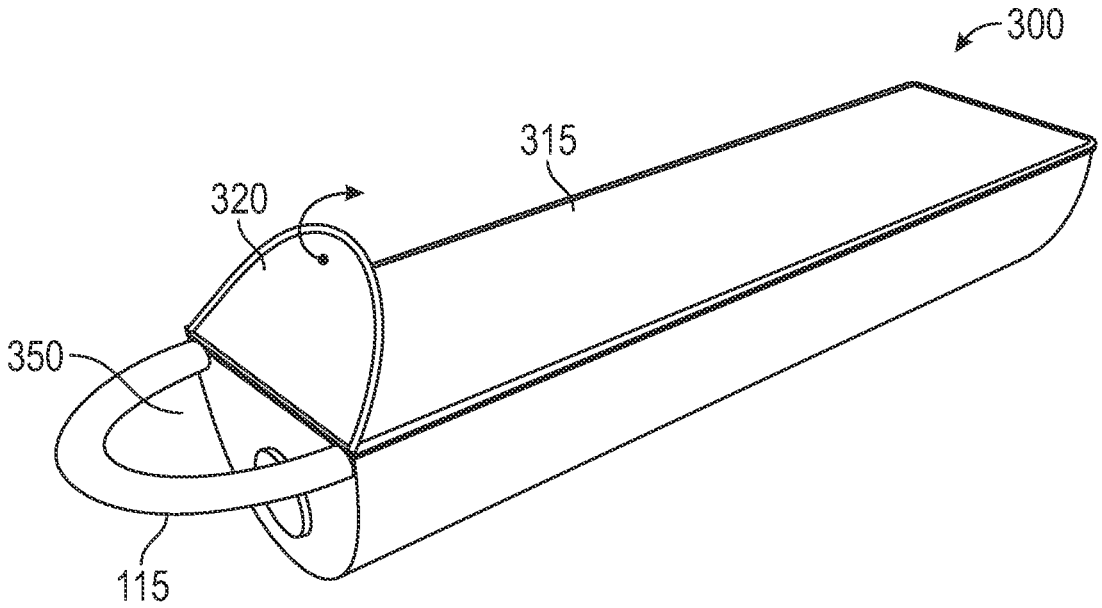
FIG. 3 shows a pull tab which can be used to remove the adhesive protection.

The device is mounted onto a flat surface, such as a wall, by adhesion. FIG. 3 illustrates the bottom surface of the housing. An adhesive protection film 315 covers the adhesive layer 105 on the bottom surface of the housing. A pull tab 320 can be pulled by the user to remove the adhesive protection film thus exposing the adhesive. The exposed adhesive is then attached to the wall.

Once the device has been attached to the wall, and the firefighting operation is over, the device can be removed from the wall, while leaving the adhesive plate permanently attached.

In an embodiment, the attachment part forms a bottom surface of the device that is actually removable from the housing holding the electronics illumination and batteries.

Figure 2A:
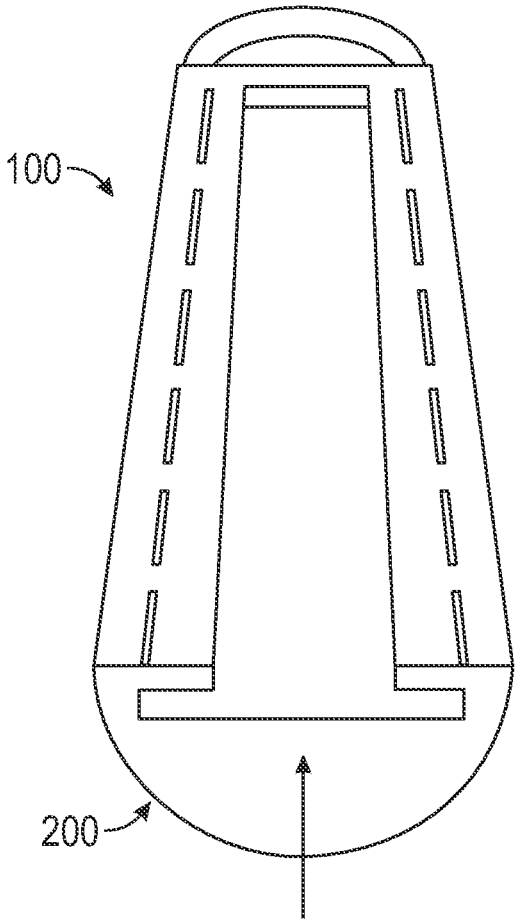
FIGS. 2A, 2B and 2C show the attachment between the main housing of the device and the adhesive back plate.
Figure 2B:
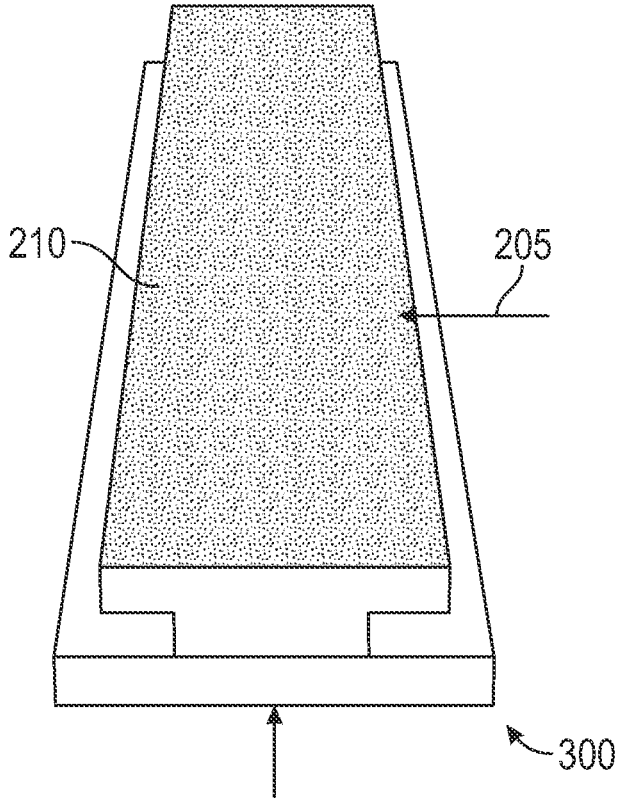
Figure 2C:
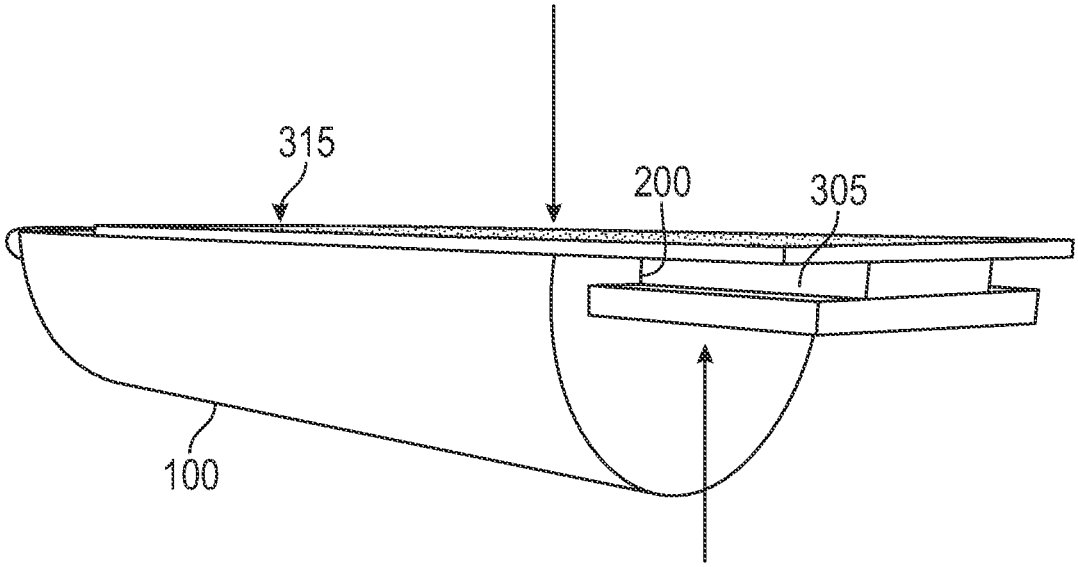

This connection is illustrated in FIGS. 2A, 2B and 2C. The housing 100 is formed with a groove area 200 on its outer perimeter. The groove fits into a tongue assembly 205 on an adhesive plate assembly 210. The bottom surface of the adhesive plate is the surface 300 which includes the adhesive and the adhesive protection film thereon. FIG. 2C shows how the groove 200 in the housing 100 fits into the tongue 205 in the adhesive plate.

Once the user is finished using the device, the housing 100 may be detached from the adhesive plate 210 by sliding it off the tongue 205 from the groove. A new adhesive plate 210 is then used the next time that the tool will be reused.

Figure 4:
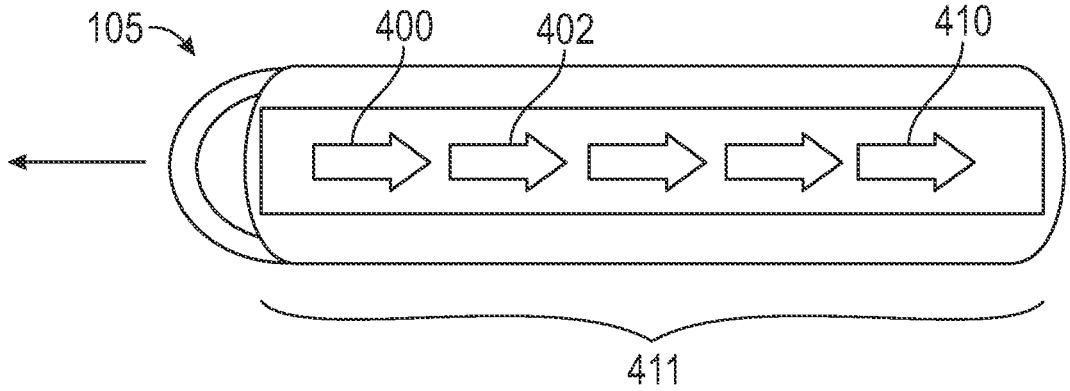
FIG. 4 shows a light sequence direction operation.

The half loop 115 is designed for multiple purposes as described below:

Function 1:

During expeditious operations in environments with limited or zero visibility, it is crucial that the device is placed in the correct direction to ensure that the sequence of the sequential lights is traveling in the direction of egress. As shown in FIG. 4, the lights in the light strip illuminate in a sequence direction starting at light 400, advancing to light 402, and continuing and so on until reaching the end light shown as 410. This is referred to as the light sequence direction, 411. This light sequence direction will always start at and travel away from the end where the half loop 105 is located. Thus, with proper training on the device, the user can mount the device with the half loop pointing in the direction of ingress while never having to directly visualize the tool, making placement faster and more intuitive.

Function 2:

During expeditious operations in environments with limited or zero visibility, the half loop 115 facilitates the user to locate the adhesive exposure film pull tab which is mounted on the back of the device. The pull tab 320, which is used to remove the film and expose the adhesive membrane for mounting, is located on the back side of the Half Loop 115 as shown in FIG. 3. Thus, the user can simply place their gloved finger through the open area 350 of the half loop and the pull tab 320 will be readily removed.

Function 3:

During expeditious operations in environments with limited or zero visibility, the user can quickly locate the Push On/Off Button 111, as shown in FIG. 1, by orienting themselves with the Half Loop 115. The Push Button 111 is located at the base of the Half Loop 115. The user can activate the device by using the Push On/Off Button 111 and then with the same finger, push through the half loop 115 to locate the pull tab 320 also located in the half loop 105. The button is wired into the electronic components to activate or deactivate battery power to the electronics.

Function 4:

The Half Loop 115 is also used to assist the user in dismounting the tool from the Adhesive Back Plate once the user is done with the tool. The Back Plate can remain on the wall OR be removed.

Figure 5A:
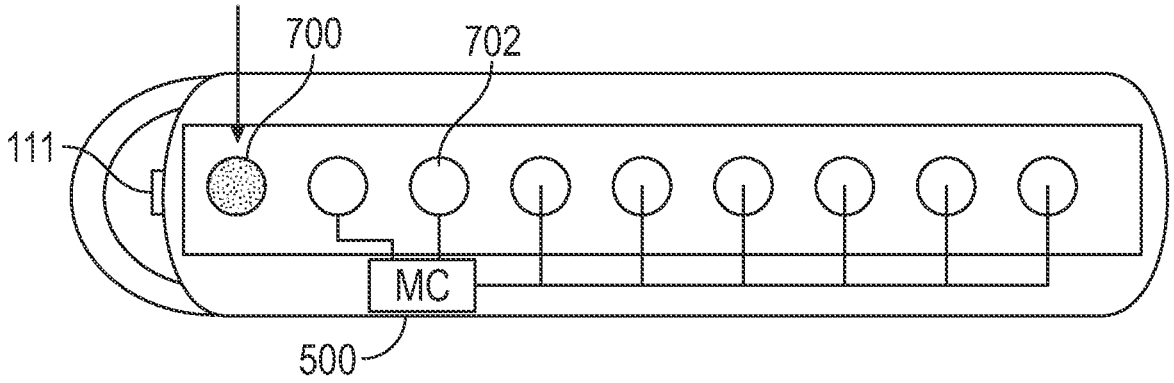
FIGS. 5A and 5B show additional aspects of the light sequence operation.
Figure 5B:
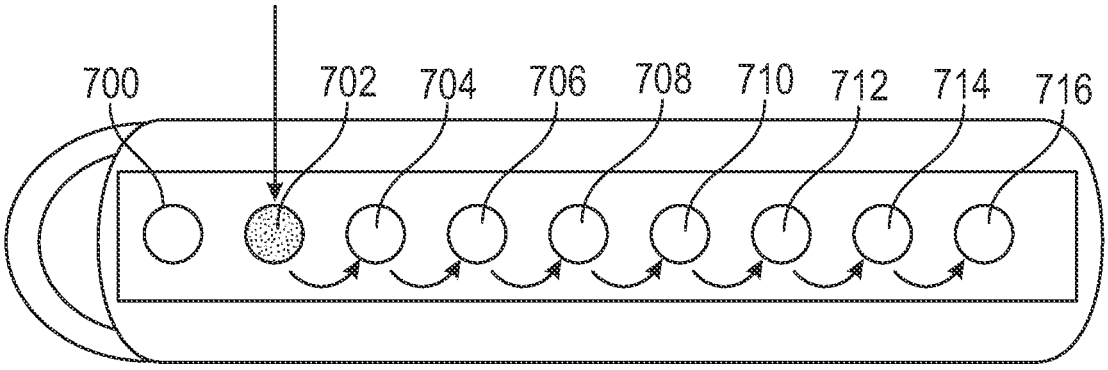

The Light Strip is constructed with programmable LED lights that are mounted on a top part of the Housing underneath the protective Lens, as shown in FIGS. 5A and 5B. The light strip is controlled by a pre-programmed microchip mounted with the Electronics Components inside the housing. Upon depressing the on off switch 111, a microcontroller 500 begins operating to first light the first LED 700 that is closest to the loop end. At the end of a time period, for example between ⅛-¼ second, the first LED 700 is extinguished, and the second LED 702 is illuminated. In a similar way, the sequence travels down between LED 702, 704, 706, 708, 710, 712, 714 until reaching the end at LED 716. This has the effect of causing the illumination to "run" in a single direction along the axis of the housing from the first end of the housing adjacent the half loop to the second end of the housing. The entire sequence takes approximately 1 second. Once the sequence is finished, after a 1 second pause, the next sequence begins starting back at the original lighting elements 700. This illumination sequence is repeated until the device is shut off by the user.

The Light Strip can also or alternately be constructed with lighting that can not be seen by the naked eye, requiring special optical imaging eyewear, such as infrared.

The lens 125 is mounted onto the top of the housing to provide protection for the lighting mechanism (LED, Infrared, etc). The Lens is constructed from a rugged material, such as epoxy, and is transparent to expose the illumination of the lighting. The Lens 125 runs the length of the housing.

Figure 6:
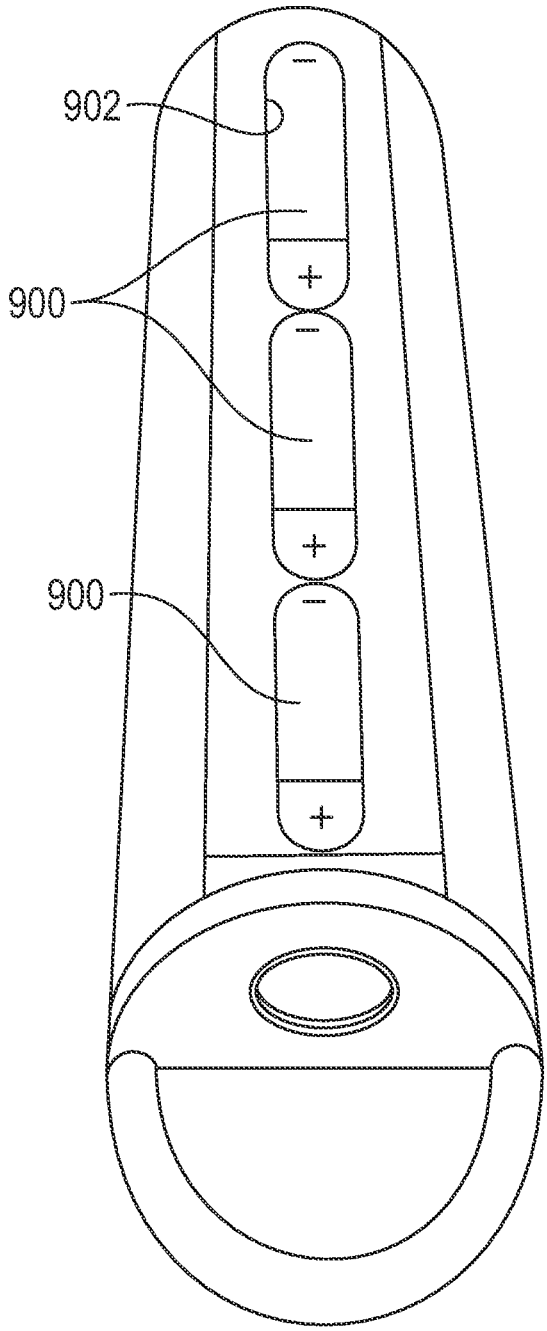
FIG. 6 shows how the batteries sit inside the housing of the device.

FIG. 6 shows the batteries 900 are held in a battery mount 902 inside the housing. Any kind of batteries can be used, including rechargeable or disposable batteries. In one embodiment, replaceable batteries are used, and the housing adhesive back plate can be removed to replace the batteries. In this embodiment, the housing has a battery access built on the back side where the adhesive back plate is mounted. When the adhesive back plate is removed, by sliding the tongue and groove connection to remove that adhesive back plate, this exposes the battery area.

In one embodiment, the batteries are sized to provide enough power for 6 hours of continuous use at minimum. In an embodiment, the device has a low battery indicator light on the outside of the housing.

The Light Strip and the On/Off Push Button are powered and controlled by the microcontroller that controls the direction and lighting of the individual lighting elements. This chip and wiring are held inside the housing along with the batteries.

In another embodiment, an audio alarm, e.g., a brief audio alarm, e.g, a beep, sounds for ¼-½ second, at intervals, e.g., of every 15 seconds. This way, if the device is in a location where it can't be seen, it can be located from the periodic beeping.

BreadCrumbs are not limited to use in Firefighting operations. The device is designed to be used by anyone who is in need of a reusable Visual Directional Indicator. It can also be manufactured with lighting that is undetectable to the naked eye, if desired, for military use, requiring special glasses to see the undetectable The previous description of the disclosed exemplary embodiments is provided to enable any person skilled in the art to make or use the present invention. Various modifications to these exemplary embodiments will be readily apparent to those skilled in the art, and the generic principles defined herein may be applied to other embodiments without departing from the spirit or scope of the invention. Thus, the present invention is not intended to be limited to the embodiments shown herein but is to be accorded the widest scope consistent with the principles and novel features disclosed herein.

What is claimed is:

1. An emergency lighting device, comprising:

a housing, having a plurality of lighting elements arranged therein in a line extending from a first end of the housing to a second end of the housing, the lighting elements being viewable from an outside of the housing;

a controller device connected to control the lighting elements to sequentially operate to create a path along the lighting elements in a first direction, from the first ent of the housing to the second end of the housing;

an adhesive plate, attachable to the housing and separable therefrom, the adhesive plate attachable to a structure, thereby attaching the housing to the structure during placement and use of the housing;

and where the adhesive plate and the housing have structures enabling the adhesive plate and the housing to separate from one another, further comprising a loop shaped device, attached to an end of the housing, the loop shaped device defining a hollow semicircular area inside the loop, wherein a bottom surface of the adhesive plate includes an adhesive, covered with an adhesive protection film, and having a pull tab at an end of the adhesive protection film, the pull tab being in the shape of the loop shaped device, and covering the hollow section of the loop shaped device, and attaching to a perimeter of the loop shaped device, and removable from the loop shaped device to create a tab which can remove the adhesive protective film from the adhesive.

2. An emergency lighting device, comprising:

a housing, having a plurality of lighting elements arranged therein in a line extending from a first end of the housing to a second end of the housing, the lighting elements being viewable from an outside of the housing;

a controller device, connected to control the lighting elements to sequentially operate to create a path along the lighting elements in a first direction, from the first end of the housing to the second end of the housing;

an adhesive plate, attachable to the housing and separable therefrom, the adhesive plate attachable to a structure, thereby attaching the housing to the structure during placement and use of the housing;

and where the adhesive plate and the housing have structures enabling the adhesive plate and the housing to separate from one another, further comprising a loop shaped device, attached to an end of the housing, the loop shaped device defining a hollow semicircular area inside the loop, wherein the sequential operate of the lighting elements include multiple lighting elements which are spaced from one another, a sequence beginning at a first lighting element closest to the loop shaped device, and traveling along the axis, turning on one lighting element while turning off a previous lighting element until reaching the edge of the housing, at which time the operation begins again at the first lighting element closest to the loop shaped device.

3. A method of using an emergency device to signal an exit path, comprising:

attaching a device to a wall, the device having a housing defining a first shape, with a loop shaped element at one end of the housing, and without a corresponding loop shaped element at the other end of the housing the attaching comprising orienting the loop shaped element in a desired direction relative to an exit;

turning on the device, to cause lighting elements in the device to sequentially operate to create a path along the housing defining a first direction of sequential illumination of the lighting elements, from one end of the housing to the other end of the housing; and after operating the device, removing an adhesive plate of the device that is attached to the wall, and reusing the housing of the device that includes the lighting elements for another operation.

4. The method as in claim 3, further comprising an on-off switch, and turning off the device using the on-off switch to put the device in an off condition in which power is not supplied, and turning on the device using the on-off switch an on condition in which power is supplied to the lighting elements, to cause the lighting elements to sequentially operate, the on-off switch being located on a surface of the housing adjoining to the loop shaped element.

5. The method as in claim 4, wherein the housing has a top surface which extends along an axis of the housing, and the path of the lighting elements extends along the axis, and the housing has side surfaces, extending at orthogonal planes to the top surface, and where the on-off switch is located on one of said side surfaces adjacent to said loop shaped element.

6. The method as in claim 3, wherein the loop shaped element is in the shape of a half loop circle and hollow in its center.

7. The method as in claim 3, wherein the adhesive plate includes an adhesive plate with an adhesive covering film and removable pull tab covering the adhesive plate.

8. The method as in claim 7, wherein the adhesive plate is attached to the housing by a slidable tongue and groove attachment, further comprising separating the adhesive plate from the housing by sliding the housing relative to the adhesive plate on the tongue and groove attachment.

9. The method as in claim 3, wherein the sequential operate of the lighting elements include multiple lighting elements which are spaced from one another, and further comprising lighting the lighting elements a sequence beginning at a first lighting element closest to the loop shaped device, and traveling along the axis, turning on one lighting element while turning off a previous lighting element until reaching the edge of the housing, at which time the operation begins again at the first lighting element closest to the loop shaped device.

10. The method as in claim 3, further comprising sounding an audio beep at predetermined intervals while the lighting elements are operating.

* * * * *